US010008218B2

(12) United States Patent
Wu et al.

(10) Patent No.: US 10,008,218 B2
(45) Date of Patent: Jun. 26, 2018

(54) BLIND BANDWIDTH EXTENSION USING K-MEANS AND A SUPPORT VECTOR MACHINE

(71) Applicant: Dolby Laboratories Licensing Corporation, San Francisco, CA (US)

(72) Inventors: Chih-Wei Wu, San Francisco, CA (US); Mark S. Vinton, Alameda, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days. days.

(21) Appl. No.: 15/667,359

(22) Filed: Aug. 2, 2017

(65) Prior Publication Data

US 2018/0040336 A1 Feb. 8, 2018

Related U.S. Application Data

(60) Provisional application No. 62/370,425, filed on Aug. 3, 2016.

(51) Int. Cl.

| | |
|---|---|
| ***H04R 3/00*** | (2006.01) |
| ***G10L 21/0388*** | (2013.01) |
| ***G10L 19/26*** | (2013.01) |

(52) U.S. Cl.

CPC ..... *G10L 21/0388* (2013.01); *G10L 19/26* (2013.01)

(58) Field of Classification Search

CPC ..... G10L 21/0388; G10L 19/26

See application file for complete search history.

(56) References Cited

U.S. PATENT DOCUMENTS

| | | | | |
|---|---|---|---|---|
| 8,463,719 | B2 | 6/2013 | Lyon | |
| 8,842,883 | B2 | 9/2014 | Chen | |
| 8,977,374 | B1 | 3/2015 | Eck | |
| 8,996,362 | B2 | 3/2015 | Neuendorf | |
| 9,117,444 | B2 | 8/2015 | Rachevsky | |
| 2010/0174539 | A1 | 7/2010 | Nandhimandalam | |
| 2010/0246849 | A1 * | 9/2010 | Sudo | H03G 3/32 381/94.1 |
| 2011/0047163 | A1 | 2/2011 | Chechik | |
| 2011/0246076 | A1 | 10/2011 | Su | |
| 2013/0132311 | A1 | 5/2013 | Liu | |
| 2015/0073306 | A1 | 3/2015 | Abeyratne | |

(Continued)

FOREIGN PATENT DOCUMENTS

| | | |
|---|---|---|
| CN | 102682219 | 9/2012 |
| CN | 103886330 | 6/2014 |

(Continued)

OTHER PUBLICATIONS

Larsen, E. et al "Audio Bandwidth Extension: Application of Psychoacoustics, Signal Processing and Loudspeaker Design" John Wiley & Sons, 312 pages, Oct. 29, 2004.

(Continued)

*Primary Examiner* — Simon King

(57) ABSTRACT

A system and method of blind bandwidth extension. The system selects a prediction model from a number of stored prediction models that were generated using an unsupervised clustering method (e.g., a k-means method) and a supervised regression process (e.g., a support vector machine), and extends the bandwidth of an input musical audio signal.

20 Claims, 7 Drawing Sheets

100

(56) References Cited

U.S. PATENT DOCUMENTS

| | | | |
|---|---|---|---|
| 2015/0089399 | A1 | 3/2015 | Megill |
| 2015/0161474 | A1 | 6/2015 | Jaber |

FOREIGN PATENT DOCUMENTS

| | | |
|---|---|---|
| CN | 104239900 | 12/2014 |
| WO | 2007/029002 | 3/2007 |

OTHER PUBLICATIONS

Ekstrand, Per "Bandwidth Extension of Audio Signals by Spectral Band Replication" Proc. 1st IEEE Benelux Workshop on Model based Processing and Coding of Audio (MPCA-2002), Leuven, Belgium, Nov. 15, 2002, pp. 53-58.
Dietz, M. et al "Spectral Band Replication, a Novel Approach in Audio Coding" in Proc. of the Audio Engineering Society Convention, presented at the 112th Convention, May 10-13, 2002, Munich, Germany, pp. 1-8.
Ferreira, A. et al "Accurate Spectral Replacement" AES Convention, Barcelona, Spain, May 28-31, 2005, pp. 1-11.
Liu, Chi-Min et al "Compression Artifacts in Perceptual Audio Coding" IEEE Transactions on Audio, Speech, and Language Processing, vol. 16, Issue 4, Apr. 15, 2008, pp. 681-695.
Zernicki, T. et al "Improved Coding of Tonal Components in MPEG-4 AAC with SBR" 16th European Signal Processing Conference, Lausanne, Switzerland, Aug. 25-29, 2008, pp. 1-5.
Nagel, F. et al "A Harmonic Bandwidth Extension Method for Audio Codecs" IEEE International Conference on Acoustics, Speech and Signal Processing, Apr. 19-24, 2009, pp. 145-148.
Zhong, H. et al "QMF Based Harmonic Spectral Band Replication" in Proc. of the Audio Engineering Society convention, presented at the 131st Convention, Oct. 20-23, 2011, New York, NY, USA, pp. 1-9.
Neukam, C. et al "A MDCT Based Harmonic Spectral Bandwidth Extension Method" IEEE International Conference on Acoustics, Speech and Signal Processing, May 26-31, 2013, pp. 566-570.
Nagel, F. et al "A Continuous Modulated Single Sideband Bandwidth Extension", in Proc. of the IEEE International Conference on Acoustics, Speech, and Signal Processing, Mar. 14-19, 2010, pp. 357-360.
Hsu, Han-Wen et al "Decimation-Whitening Filter in Spectral Band Replication" IEEE Transactions on Audio, Speech and Language Processing, vol. 19, No. 8, Nov. 2011, pp. 2304-2313.
Larsen, E. et al "Efficient High-Frequency Bandwidth Extension of Music and Speech" AES presented at the 112th Convention, May 10-13, 2002, Munich, Germany, pp. 1-5.
Arora, M. et al "High Quality Blind Bandwidth Extension of Audio for Portable Player Applications" in Proc. of the Audio Engineering Society Convention presented at the 120th Convention, May 20-23, 2006, Paris, France, pp. 1-6.
Habigt, T. et al "Enhancing 3D Audio Using Blind Bandwidth Extension" presented at the 129th AES Convention, Nov. 4-7, 2010, San Francisco, USA, pp. 1-5.
Budsabathon, C. et al "Bandwidth Extension with Hybrid Signal Extrapolation for Audio Coding" IEICE Trans. Fundamentals, vol. E90-A, No. 8, Aug. 2007, pp. 1564-1569.
Sha, Yong-Tao, et al "High Frequency Reconstruction of Audio Signal Based on Chaotic Prediction Theory", in Proc. of the IEEE International Conference on Acoustics, Speech, and Signal Processing, pp. 381-384, Mar. 14-19, 2010.
Liu, X. et al "Nonlinear Bandwidth Extension Based on Nearest-Neighbor Matching", in Proc. of the APSIPA Annual Summit and Conference, Biopolis, Singapore, pp. 169-172, Dec. 14-17, 2010.
Liu, X. et al. "A harmonic bandwidth extension based on Gaussian mixture model," in Proc. of the IEEE International Conference on Signal Processing (ICSP), No. 60872027, pp. 474-477, Oct. 24-28, 2010.
Liu, X. et al. "Blind bandwidth extension of audio signals based on non-linear prediction and hidden Markov model," APSIPA Transactions on Signal and Information Processing, vol. 3, no. Jul. 2014, p. e8.
Liu, H.J. et al."Spectral envelope estimation used for audio bandwidth extension based on RBF neural network," in Proc. of the IEEE International Conference on Acoustics, Speech, and Signal Processing (ICASSP), pp. 543-547, May 26-31, 2013.
Li, K. et al "A deep neural network approach to speech bandwidth expansion," in Proc. of the IEEE International Conference on Acoustics, Speech, and Signal Processing (ICASSP), Apr. 19-24, 2015, pp. 4395-4399.
Epps, J. et al."A new technique for wideband enhancement of coded narrowband speech," in Proc. of the IEEE Workshop on Speech Coding, Jun. 20-23, 1999, pp. 174-176.
Enbom, N. et al, "Bandwidth expansion of speech based on vector quantization of the Mel frequency ceptral coefficients," in Proc. of the IEEE Workshop on Speech Coding, Jun. 20-23, 1999, pp. 171-173.
Jeon, J. et al "Robust artificial bandwidth extension technique using enhanced parameter estimation," in Proc. of the Audio Engineering Society Convention (AES), (Los Angeles, USA), Oct. 2014.
Nakatoh, Y. et al "Generation of broadband speech from narrowband speech based on linear mapping," Electronics and Communications in Japan, Part II: Electronics (English translation of Denshi Tsushin Gakkai Ronbunshi), vol. 85, No. 8, pp. 44-53, Jul. 9, 2002.
Park, K.Y. et al "Narrowband to wideband conversion of speech using GMM based transformation," in Proc. of the IEEE International Conference on Acoustics, Speech, and Signal Processing (ICASSP), vol. 3, pp. 1843-1846, Jun. 5-9, 2000.
Jax, P. et al "On artificial bandwidth extension of telephone speech," Signal Processing, vol. 83, No. 8, pp. 1707-1719, Aug. 2003.
Seung, D. et al "Algorithms for non-negative matrix factorization," in Advances in neural information processing systems, No. 13, pp. 556-562, 2001.
Smaragdis, P. et al. "Example-driven bandwidth expansion," in Proc. of the IEEE Workshop on Applications of Signal Processing to Audio and Acoustics, pp. 135-138, Oct. 21-24, 2007.
Bansal, D. et al. "Bandwidth Expansion of Narrowband Speech Using Non-Negative Matrix Factorization," in Proc. of the Interspeech, 2005.
Vapnik, Vladimir, The Nature of Statistical Learning Theory. Springer, 1995.
Chang, Chih-Chung, et al. "LIBSVM : a library for support vector machines," ACM Trans-actions on Intelligent Systems and Technology, vol. 2, No. 3, pp. 27:1-27:27, 2011.
Lerch, A. "An Introduction to Audio Content Analysis: Applications in Signal Processing and Music Informatics" John Wiley & Sons, 2012.
Tzanetakis, G. et al. "Musical genre classification of audio signals," IEEE Transactions on Speech and Audio Processing, vol. 10, No. 5, pp. 293-302, Nov. 7, 2002.
Fu, Z. et al. "A Survey of Audio-Based Music Classification and Annotation," IEEE Transactions on Multimedia, vol. 13, pp. 303-319, Apr. 2011.
Theodoridis, S. et al., Pattern Recognition. Academic Press, 4 ed., 2009.
Hastie, T. et al "Chapter 13—Prototype Methods and Nearest-Neighbors", in The Elements of Statistical Learning: Data Mining, Inference, and Prediction, Second Edition (Springer Series in Statistics) (2nd ed. 2009, corr. 10th printing 2013 Edition).
Zhang, Xing-Tao "A Blind Bandwidth Method of Audio Signals Based on Volterra Series" IEEE, Dec. 2012.
Kolozali, S. et al "Automatic Ontology Generation for Musical Instruments Based on Audio Analysis" IEEE Transactions on Audio, Speech, and Language Processing, vol. 21, Issue 10, pp. 2207-2220, May 17, 2013.
Wadhwa, Aseem "Scalable Front End Designs for Communication and Learning" University of California, Santa Barbara, ProQuest Dissertations Publishing, 2014.
Yao, S. et al "Speech Bandwidth Enhancement Using State Space Speech Dynamics" Acoustics, Speech and Signal Processing, May 14-19, 2006.

(56) References Cited

OTHER PUBLICATIONS

Dietz, M. et al "Spectral Band Replication, a Novel Approach in Audio Coding" AES vol. 112, No. 5553, May 10, 2002, pp. 1-08.
Wang, Y. et al "Speech Bandwidth Extension Based on GMM and Clustering Method" Apr. 30, 2015, pp. 437-441.
Lyubimov, N. et al "Audio Bandwidth Extension Using Cluster Weighted Modeling of Spectral Envelopes" AES Oct. 2009.
Hastie, T. "Chapter 12-Support Vector Machines and Flexible Determinants", in The Elements of Statistical Learning: Data Mining, Inference, and Prediction, Second Edition (Springer Series in Statistics) 2nd edition corr. 10th printing, 2013 edition.

* cited by examiner

BLIND BANDWIDTH EXTENSION USING K-MEANS AND A SUPPORT VECTOR MACHINE

CROSS REFERENCE TO RELATED APPLICATIONS

The present application claims priority to U.S. Provisional Patent Application No. 62/370,425, filed Aug. 3, 2016, which is incorporated herein by reference in its entirety.

BACKGROUND

The present invention relates to bandwidth extension, and in particular, to blind bandwidth extension.

Unless otherwise indicated herein, the approaches described in this section are not prior art to the claims in this application and are not admitted to be prior art by inclusion in this section.

With the increasing popularity of mobile devices (i.e., smartphones, tablets) and online music streaming services (i.e., Apple Music, Pandora, Spotify, etc.), the capability of providing high quality audio content with minimum data requirement becomes more important. To ensure a fluent user experience, the audio content could be heavily compressed and lose its high-band information during the transmission. Similarly, users may possess legacy audio content that was heavily compressed (e.g., due to past storage concerns that may no longer be applicable). This compression process may cause degradation to the perceptual quality of the content. An audio bandwidth extension method is to address this problem and restore the high-band information to improve the perceptual quality. In general, audio bandwidth extension can be categorized into two types of approaches: Non-blind and Blind.

In Non-blind bandwidth extension, the band-limited signal is reconstructed at the decoder with side information provided. This type of approach can generate high quality results since more information are available. However, it also increases the data requirement and might not be applicable in some use cases. The most well-known method in this category is Spectral Band Replication (SBR). SBR is a technique that has been used in the existing audio codecs such as MPEG-4 (Motion Picture Experts Group) High-Efficiency Advanced Audio Coding (HE-AAC). SBR can improve the efficiency of the audio coder at low-bit rate by encapsulating the high frequency content and recreating it based on the transmitted low frequency portion with high-band information. Another technique, Accurate Spectral Replacement (ASR), explores a similar idea with a different approach. ASR uses the sinusoidal modeling technique to analyze the signal at the encoder, and re-synthesize the signal at the decoder with transmitted parameters and bandwidth extended residuals. SBR, being a simple and efficient algorithm, still introduces some artifacts to the signals. One of the most obvious issues is the mismatch in the harmonic structures caused by the process of the band replication to create the missing high frequency content. To improve the patching algorithm, a sinusoidal modeling based method was proposed to generate the missing tonal components in SBR. Another approach is to use a phase vocoder to create the high frequency content by pitch shifting the low frequency part. The other approaches, such as offset adjustment between the replicated spectrum or a better inverse filtering process, have also been proposed to improve the patching algorithm in SBR.

In Blind bandwidth extension, the band-limited signal is reconstructed at the decoder without giving any side information. This type of approach mainly focuses on general improvement instead of faithful reconstruction. One approach is to use a wave-rectifier to generate the high frequency content, and use different filters to shape the resulting spectrum. This approach has a lower model complexity and does not require a training process. However, the filter design becomes crucial and can be difficult to optimize. The other approaches, such as linear predictive extrapolation and chaotic prediction theory, predict the missing values without any training process. For more complex approaches, machine learning algorithms have been applied. For example, envelope estimation using Gaussian Mixture Model (GMM), Hidden Markov Model (HMM) and Neural Network have been proposed. These approaches in general require a training phase to build the prediction models.

For methods focusing on blind speech bandwidth extension, Linear Prediction Coefficients (LPC) is commonly used to extract the spectral envelope and excitation from the speech. A codebook can then be used to map the envelope or excitation from narrowband to wideband. Other approaches, such as linear mapping, GMM and HMM, have been proposed to predict the wide-band spectral envelopes. Combing the extended envelope and excitation, the bandwidth extended speech can then be synthesized through LPC.

SUMMARY

However, as compared to speech signals, bandwidth extension for music signals presents additional complications. For example, the fine structure of the high-bands are more important in music than in speech. Therefore, a LPC based method might not be directly applicable. As further detailed below, embodiments predict different sub-bands individually based on the extracted audio features. To obtain better and more precise predictors, embodiments apply an unsupervised clustering technique prior to the training of the predictors.

According to an embodiment, a method performs blind bandwidth extension of a musical audio signal. The method includes storing, by a memory, a plurality of prediction models. The plurality of prediction models were generated using an unsupervised clustering method and a supervised regression process. The method further includes receiving, by a processor, an input audio signal. The input audio signal has a frequency range between zero and a first frequency. The method further includes processing, by the processor, the input audio signal using a time-frequency transformer to generate a plurality of subbands. The method further includes extracting, by the processor, a subset of subbands from the plurality of subbands, where a maximum frequency of the subset is less than a cutoff frequency. The method further includes extracting, by the processor, a plurality of features from the subset of subbands. The method further includes selecting, by the processor, a selected prediction model from the plurality of prediction models using the plurality of features. The method further includes generating, by the processor, a second set of subbands by applying the selected prediction model to the subset of subbands, where a maximum frequency of the second set of subbands is greater than the cutoff frequency. The method further includes processing, by the processor, the subset of subbands and the second set of subbands using an inverse time-frequency transformer to generate an output audio signal, where the output audio signal has a maximum frequency greater than the first frequency. The method further includes outputting, by a speaker, the output audio signal.

The unsupervised clustering method may be a k-means method, the supervised regression process may be a support vector machine, the time-frequency transformer may be a quadrature mirror filter, and the inverse time-frequency transformer may be an inverse quadrature mirror filter.

Generating the second set of subbands may include generating a predicted envelope based on the selected prediction model, generating an interim set of subbands by performing spectral band replication on the subset of subbands, and generating the second set of subbands by adjusting the interim set of subbands according to the predicted envelope.

The plurality of prediction models may have a plurality of centroids. Selecting the selected prediction model may include calculating, for the plurality of features for a current block, a plurality of distances between the current block and the plurality of centroids; and selecting the selected prediction model based on a smallest distance of the plurality of distances. Selecting the selected prediction model may include calculating, for the plurality of features for a current block, a plurality of distances between the current block and the plurality of centroids; selecting a subset of the plurality of prediction models having a smallest subset of distances; and aggregating the subset of the plurality of prediction models to generate a blended prediction model, where the blended prediction model is selected as the selected prediction model.

The plurality of features may include a plurality of spectral features and a plurality of temporal features. The plurality of spectral features may include a centroid feature, a flatness feature, a skewness feature, a spread feature, a flux feature, a mel frequency cepstral coefficients feature, and a tonal power ratio feature. The plurality of temporal features may include a root mean square feature, a zero crossing rate feature, and an autocorrelation function feature.

The method may further include generating the plurality of prediction models from a plurality of training audio data using the unsupervised clustering method and the supervised regression process. Generating the plurality of prediction models may include processing the plurality of training audio data using a second time-frequency transformer to generate a second plurality of subbands. Generating the plurality of prediction models may further include extracting high frequency envelope data from the second plurality of subbands. Generating the plurality of prediction models may further include extracting low frequency envelope data from the second plurality of subbands. Generating the plurality of prediction models may further include extracting a second plurality of features from the low frequency envelope data. Generating the plurality of prediction models may further include performing clustering on the second plurality of features using the unsupervised clustering method to generate a clustered second plurality of features. Generating the plurality of prediction models may further include performing training by applying the supervised regression process to the clustered second plurality of features and the high frequency envelope data, to generate the plurality of prediction models. The training may be performed by using a radial basis function kernel for the supervised regression process.

According to an embodiment, an apparatus performs blind bandwidth extension of a musical audio signal. The apparatus includes a processor, a memory, and a speaker. The memory stores a plurality of prediction models, where the plurality of prediction models were generated using an unsupervised clustering method and a supervised regression process. The processor may be further configured to perform one or more of the method steps described above.

According to an embodiment, a non-transitory computer readable medium stores a computer program for controlling a device to perform blind bandwidth extension of a musical audio signal. The device may include a processor, a memory and a speaker. The memory stores a plurality of prediction models, where the plurality of prediction models were generated using an unsupervised clustering method and a supervised regression process. The computer program when executed by the processor may control the device to perform one or more of the method steps described above.

The following detailed description and accompanying drawings provide a further understanding of the nature and advantages of various implementations.

DETAILED DESCRIPTION

Described herein are techniques for blind bandwidth extension. In the following description, for purposes of explanation, numerous examples and specific details are set forth in order to provide a thorough understanding of the present invention. It will be evident, however, to one skilled in the art that the present invention as defined by the claims may include some or all of the features in these examples alone or in combination with other features described below, and may further include modifications and equivalents of the features and concepts described herein.

In the following description, various methods, processes and procedures are detailed. Although particular steps may be described in a certain order, such order is mainly for convenience and clarity. A particular step may be repeated more than once, may occur before or after other steps (even if those steps are otherwise described in another order), and may occur in parallel with other steps. A second step is required to follow a first step only when the first step must be completed before the second step is begun. Such a situation will be specifically pointed out when not clear from the context.

In this document, the terms "and", "or" and "and/or" are used. Such terms are to be read as having an inclusive meaning. For example, "A and B" may mean at least the following: "both A and B", "at least both A and B". As another example, "A or B" may mean at least the following: "at least A", "at least B", "both A and B", "at least both A and B". As another example, "A and/or B" may mean at least the following: "A and B", "A or B". When an exclusive-or is intended, such will be specifically noted (e.g., "either A or B", "at most one of A and B").

This document uses the terms "audio", "audio signal" and "audio data". In general, these terms are used interchangeably. When specificity is desired, the term "audio" is used to refer to the input captured by a microphone, or the output generated by a loudspeaker. The term "audio data" is used to refer to data that represents audio, e.g. as processed by an analog to digital converter (ADC), as stored in a memory, or as communicated via a data signal. The term "audio signal" is used to refer to audio transmitted in analog or digital electronic form.

Figure 1:
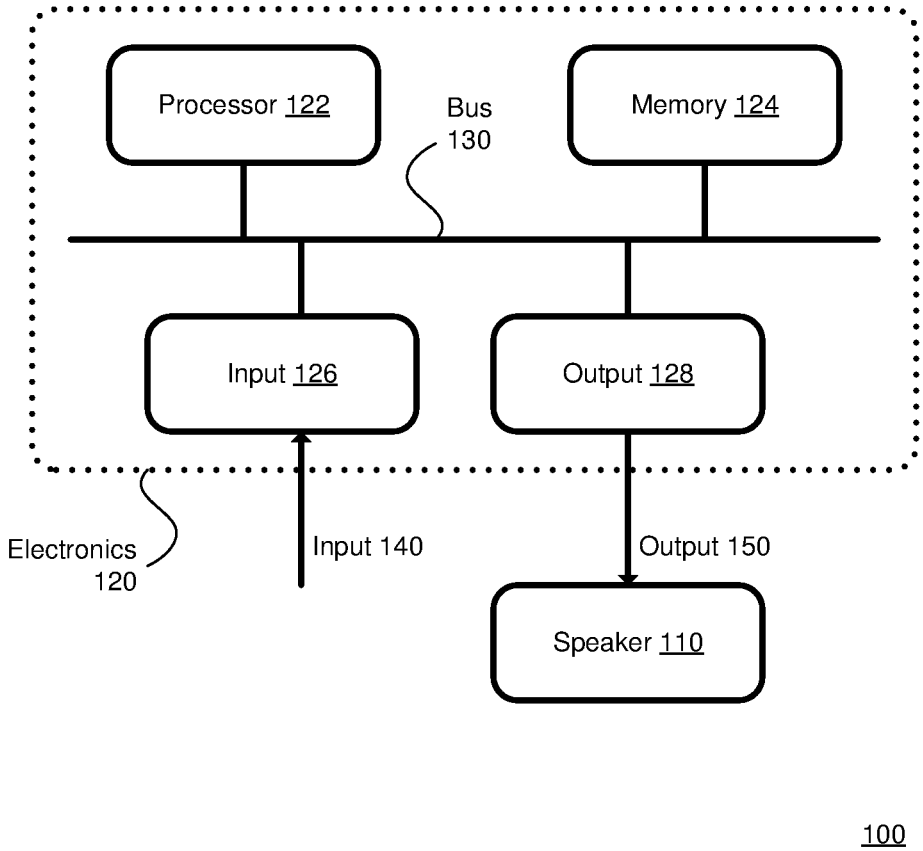
FIG. 1 is a block diagram of a system 100 for blind bandwidth extension of music signals.

FIG. 1 is a block diagram of a system 100 for blind bandwidth extension of music signals. The system 100 includes a speaker 110 and electronics 120. The electronics 120 include a processor 122, a memory 124, an input interface 126, an output interface 128, and a bus 130 that connects the components. The electronics 120 may include other components that—for brevity—are not shown. The electronics 120 receive an input audio signal 140 and generate an output audio signal 150 to the speaker 110. The electronics 120 may operate according to a computer program stored in the memory 124 and executed by the processor 122.

The processor 122 generally controls the operation of the electronics 120. As further detailed below, the processor 122 performs the blind bandwidth extension of the input audio signal 140.

The memory 124 generally stores data used by the electronics 120. The memory 124 may store a number of prediction models, as detailed in subsequent sections. The memory 124 may store a computer program that controls the operation of the electronics 120. The memory 124 may include volatile and non-volatile components, such as random access memory (RAM), read only memory (ROM), solid state memory, etc.

The input interface 126 generally provides an input interface for the electronics 120 to receive the input audio signal 140. For example, when the input audio signal 140 is received from a transmission, the input interface 126 may interface with a transmitter component (not shown). As another example, when the input audio signal 140 is stored locally, the input interface 126 may interface with a storage component (not shown, or alternatively a component of the memory 124).

The output interface 128 generally provides an output interface for the electronics to output the output audio signal 150.

The speaker 110 generally outputs the output audio signal 150. The speaker 110 may include multiple speakers, such as two speakers (e.g., stereo speakers, a headset, etc.) or surround speakers.

The system 100 generally operates as follows. The system 100 receives the input audio signal 140, performs blind bandwidth extension (as further detailed in subsequent sections), and outputs a bandwidth-extended music signal (corresponding to the output signal 150) from the speaker 110.

Figure 2A:
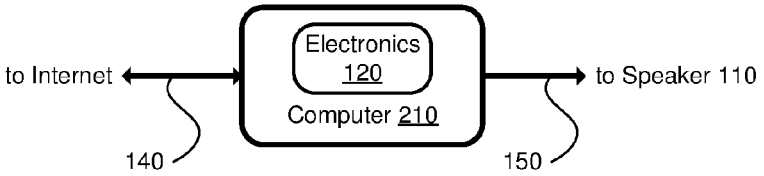
FIG. 2A is a block diagram of a computer system 210.
Figure 2B:
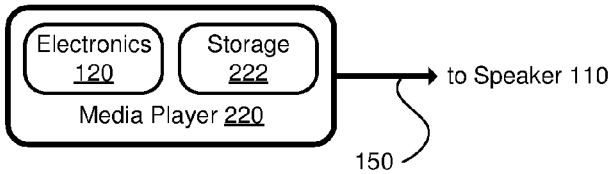
FIG. 2B is a block diagram of a media player 220.
Figure 2C:
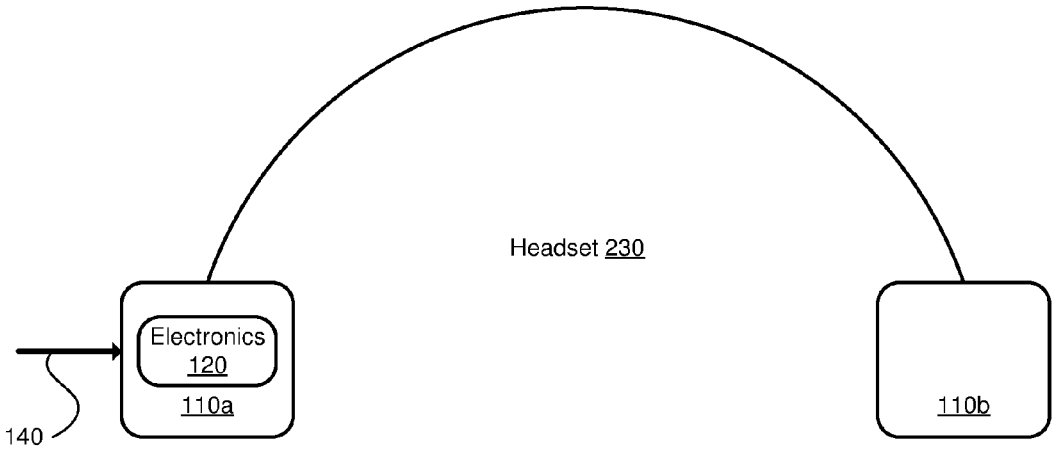
FIG. 2C is a block diagram of a headset 230.

FIGS. 2A-2C are block diagrams that illustrate various implementations for the system 100 (see FIG. 1). FIG. 2A is a block diagram of a computer system 210. The computer system 210 includes the electronics 120 (see FIG. 1) and connects to the speaker 110 (e.g., stereo or surround speakers). The computer system 210 receives the input audio signal 140 from a computer network such as the internet, a wireless network, etc. and outputs the output audio signal 150 using the speaker 110. (Alternatively, the input audio signal 140 may be stored locally by the computer system 210 itself.) As an example, the computer system 210 may have a low bandwidth connection, resulting in the input audio signal 140 being bandwidth-limited. As another example, the computer system 210 may have stored legacy audio that was bandwidth-limited at the time it was created. As a result, the computer system 210 uses the electronics 120 to perform blind bandwidth extension.

FIG. 2B is a block diagram of a media player 220. The media player 220 includes the electronics 120 (see FIG. 1) and storage 222, and connects to the speaker 110 (e.g., headphones). The storage 222 stores data corresponding to the input audio signal 140, which may be loaded into the storage 222 in various ways (e.g., synching the media player 220 to a music library, etc.). As an example, the music data corresponding to the input audio signal 140 may have been stored or transmitted in a bandwidth-limited format due to resource concerns for the storage or transmission. As a result, the media player 220 uses the electronics 120 to perform blind bandwidth extension.

FIG. 2C is a block diagram of a headset 230. The headset 230 includes the electronics 120 (see FIG. 1) and two speakers 110*a* and 110*b*. The headset 230 receives the input audio signal 140 (e.g., from a computer, media player, etc.). As an example, the input audio signal 140 may have been stored or transmitted in a bandwidth-limited format due to resource concerns for the storage or transmission. As a result, the headset 230 uses the electronics 120 to perform blind bandwidth extension.

Figure 3:
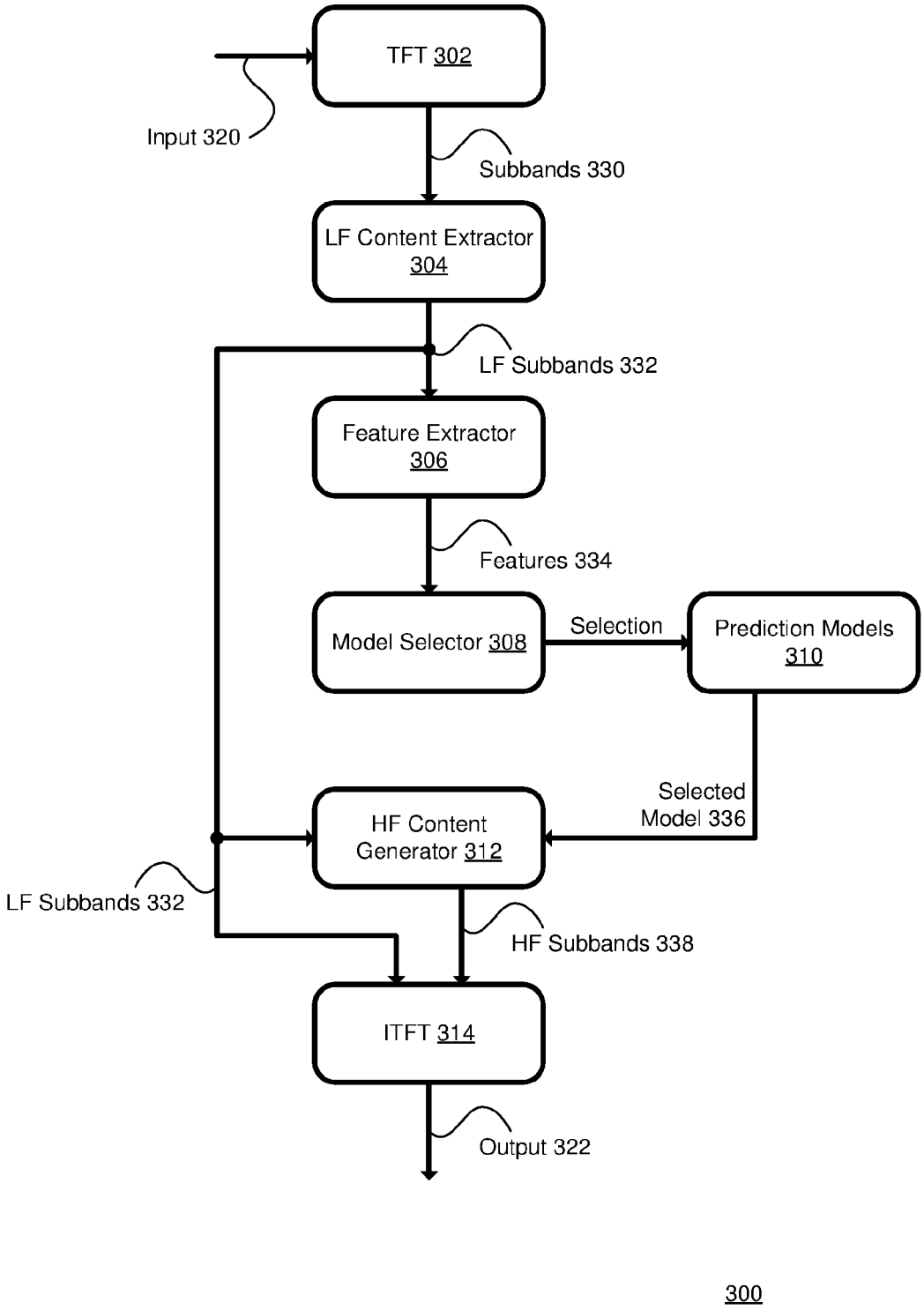
FIG. 3 is a block diagram of a system 300 for blind bandwidth extension of music signals.

FIG. 3 is a block diagram of a system 300 for blind bandwidth extension of music signals. The system 300 may be implemented by the electronics 120 (see FIG. 1), for example by executing a computer program. The system 300 includes a time-frequency transformer (TFT) 302, a low frequency (LF) content extractor 304, a feature extractor 306, a model selector 308, a memory storing a number of prediction models 310, a high frequency (HF) content generator 312, and an inverse time-frequency transformer (ITFT) 314. The prediction models 310 were generating using an unsupervised clustering method (e.g., a k-means method) and a supervised regression process (e.g., a support vector machine), as further detailed in subsequent sections.

In general, the system 300 receives an input musical audio signal 320, performs blind bandwidth extension, and generates a bandwidth-extended output musical audio signal 322. More specifically, the TFT 302 receives the input signal 320, performs a time-frequency transform on the input signal 320, and generates a number of subbands 330 (e.g., converts the time domain information into frequency domain information). The TFT 302 implement one of a variety of time-frequency transforms, including discrete Fourier transform (DFT), discrete cosine transform (DCT), modified discrete cosine transform (MDCT), quadrature mirror filtering (QMF), etc.

The LF content extractor 304 receives the subbands 330 and extracts the LF subbands 332. The LF subbands 332 may be those subbands less than a cutoff frequency such as 7 kiloHertz. The feature extractor 306 receives the LF subbands 332 and extracts features 334. The model selector 308 receives the features 334 and selects one of the prediction models 310 (as the selected model 336) based on the features 334. The HF content generator 312 receives the LF subbands 332 and the selected model 336, and generates HF subbands 338 by applying the selected model 336 to the LF subbands 332. The maximum frequency of the HF subbands 338 is greater than the cutoff frequency. The ITFT 314 performs inverse transformation on the LF subbands 332 and the HF subbands 338 to generate the output signal 322 (e.g., converts the frequency domain information into time domain information).

Figure 4A:
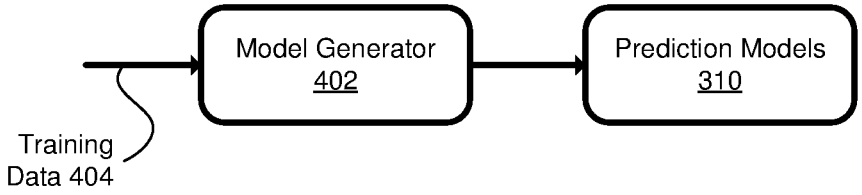
FIG. 4A is a block diagram of a model generator 402.
Figure 4B:
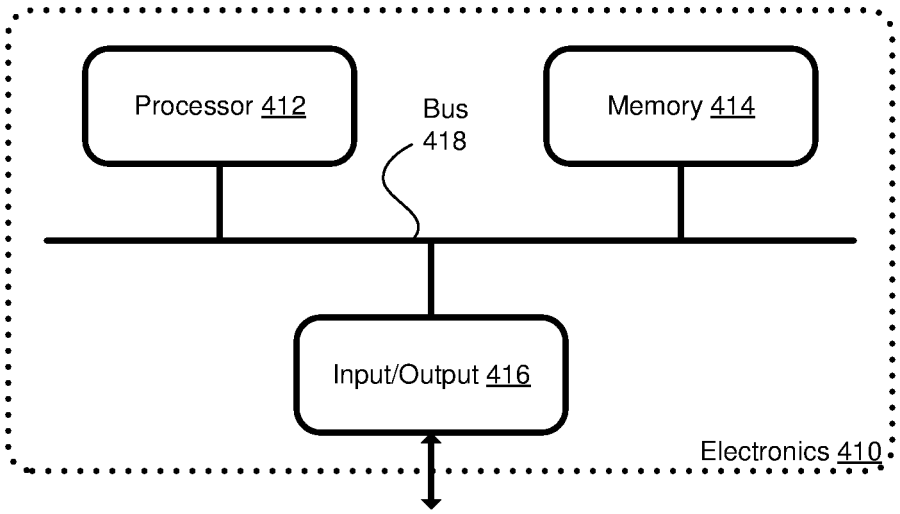
FIG. 4B is a block diagram of electronics 410 that implement the model generator 402.
Figure 4C:
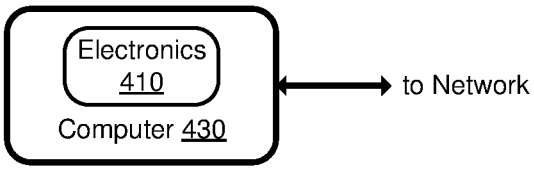
FIG. 4C is a block diagram of a computer 430.
Figure 5A:
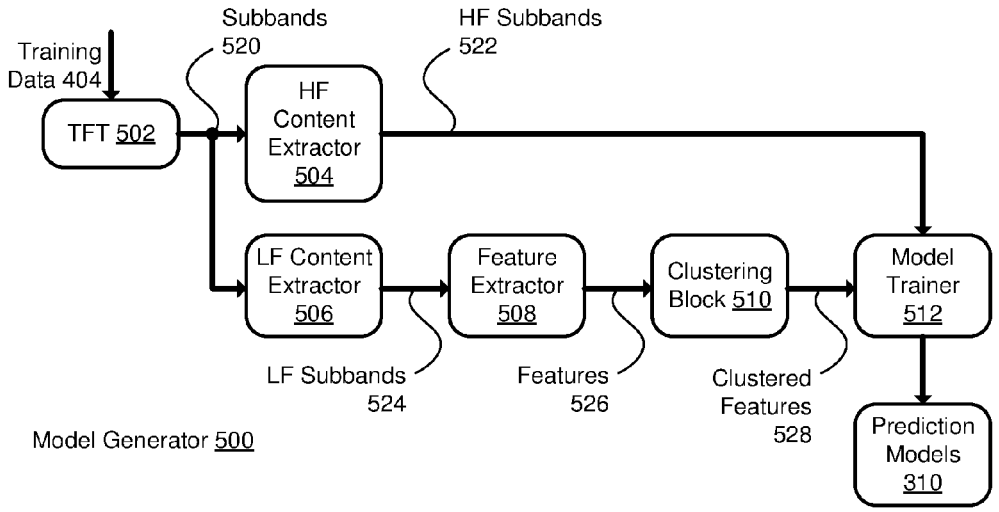
FIG. 5A is a block diagram of a model generator 500.
Figure 5B:
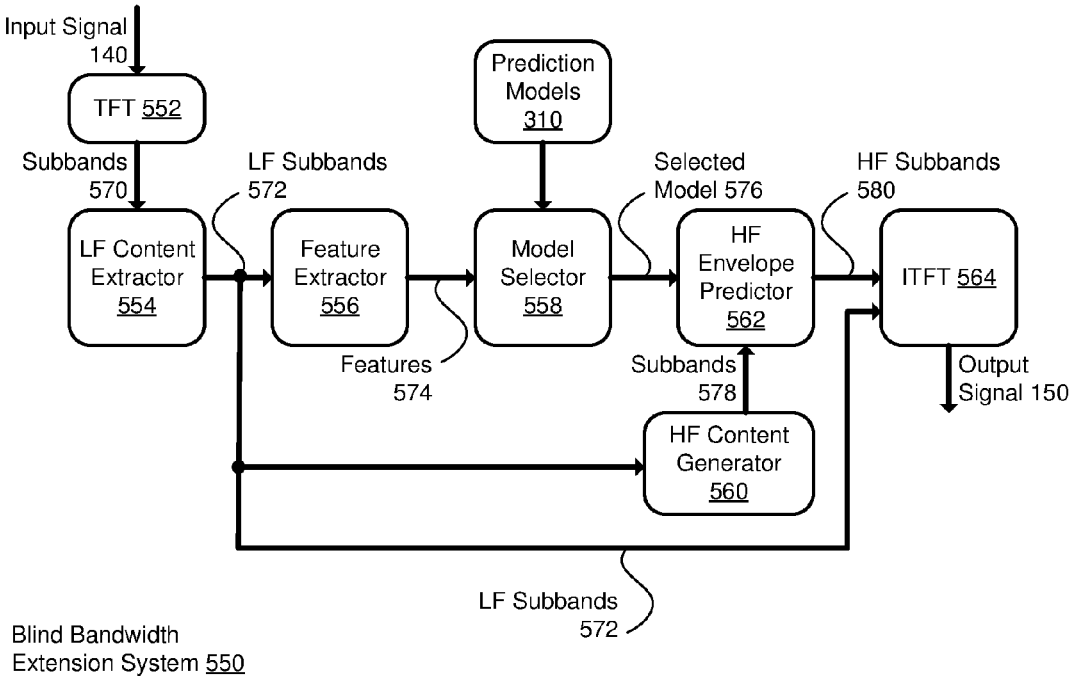
FIG. 5B is a block diagram of a blind bandwidth extension system 550.

Further details of the system 300 are provided in FIGS. 5A-5B and subsequent paragraphs, and additional details relating to the prediction models 310 are provided in FIGS. 4A-4C.

FIGS. 4A-4C are block diagrams relating to a model generator for generating the prediction models 310 (see FIG. 3). FIG. 4A is a block diagram of a model generator 402. The model generator 402 receives training data 404 and generates the prediction models 310 (see FIG. 3). The model generator 402 implements an unsupervised clustering method (e.g., a k-means method) and a supervised regression process (e.g., a support vector machine), as further detailed in subsequent sections.

FIG. 4B is a block diagram of electronics 410 that implement the model generator 402. The electronics 410 include a processor 412, a memory 414, an interface 416, and a bus 418 that connects the components. The electronics 410 may include other components that—for brevity—are not shown. The electronics 410 may operate according to a computer program stored in the memory 414 and executed by the processor 412.

The processor 412 generally controls the operation of the electronics 120. As further detailed below, the processor 412 generates the prediction models 310 based on the training data 404.

The memory 414 generally stores data used by the electronics 410. The memory 414 may store the training data 404. The memory 414 may store a computer program that controls the operation of the electronics 410. The memory 414 may include volatile and non-volatile components, such as random access memory (RAM), read only memory (ROM), solid state memory, etc.

The interface 416 generally provides an input interface for the electronics 410 to receive the training data 404, and an output interface for the electronics 410 to output the prediction models 310.

FIG. 4C is a block diagram of a computer 430. The computer 430 includes the electronics 410. The computer 430 connects to a network, for example to input the training data 404, or to output the prediction models 310.

The computer 430 then works with the use cases of FIGS. 2A-2C to form a blind bandwidth extension system. For example, the computer 430 may generate the prediction models 310 that are stored by the computer system 210 (see FIG. 2A), the media player 220 (see FIG. 2B), or the headset 230 (see FIG. 2C).

Blind Bandwidth Extension System

FIGS. 5A-5B are block diagrams of a blind bandwidth extension system. FIG. 5A is a block diagram of a model generator 500, and FIG. 5B is a block diagram of a blind bandwidth extension system 550. The model generator 500 shows additional details related to the model generators of FIGS. 4A-4C, and the blind bandwidth extension system 550 shows additional details related to the systems of FIGS. 1, 2A-2C and 3. Similar components have similar names and reference numbers. In a manner similar to the previous figures, the model generator 500 generates the prediction models 310, and the blind bandwidth extension system 550 uses the prediction models 310 to generate the bandwidth-extended musical output signal 150 from the bandwidth-limited musical input signal 140. The model generator 500 may be implemented by a computer system (e.g., the computer system 430 of FIG. 4C), and the blind bandwidth extension system 550 may be implemented by electronics (e.g., the electronics 120 of FIG. 1).

The model generator 500 and the blind bandwidth extension system 550 generally interoperate as follows. In a training phase, the model generator 500 extracts various audio features and clusters the extracted features into groups (e.g., into k groups using a k-means method), and trains different sets of envelope predictors (e.g., k sets when using the k-means method). In the testing phase, the blind bandwidth extension system 550 performs feature extraction, then performs a block-wise model selection; the best model is selected based on the distance between the current block and the centroids (e.g., k centroids when using the k-means method). The blind bandwidth extension system 550 then uses the selected model to predict the high frequency spectral envelope and reconstruct the high frequency content.

Model Generator 500

In FIG. 5A, the model generator 500 includes a time-frequency transformer (TFT) 502, a high frequency (HF) content extractor 504, a low frequency (LF) content extractor 506, a feature extractor 508, a clustering block 510, and a model trainer 512. In general, the model generator 500 generates the prediction models 310 from the training data 404. The details of these components are provided in subsequent sections.

Training Data 404

Various data sources may be used as the training data 404, as the choice of the training data 404 influences the results of the prediction models 310. Two data sources have been used with embodiments described herein. The first data source includes 100 musical tracks from the popular music genre, in "aiff" file format, having a sample rate of 44.1 kiloHertz. These tracks range between 2 and 6 minutes in length. As an example, the first data source may be the "RWC_POP" collection of Japanese pop songs from the AIST (National Institute of Advanced Industrial Science and Technology) RWC (Real World Computing) Music Dataset.

The second data source includes 791 musical tracks from a variety of genres, including popular music, instrumental sounds, singing voices, and human speech. These tracks are in two channel stereo, in "wav" file format, have assorted sample rates between 44.1 and 48 kiloHertz, and range between 30 seconds and 42 minutes in length (with most between 1 and 6 minutes).

The data sources may be down-mixed to a single channel. The data sources may be resampled to a sampling rate of 44.1 kiloHertz. Instead of using the entirety of a long track, a short excerpt (e.g., between 10 and 30 seconds) may be used instead (e.g., from the beginning of the track).

Time-Frequency Transformer 502

The TFT 502 generally generates a number of subbands 520 from the training data 404 (e.g., converts the time domain information into frequency domain information). The TFT 502 implement one of a variety of time-frequency transforms, including discrete Fourier transform (DFT), discrete cosine transform (DCT), modified discrete cosine transform (MDCT), quadrature mirror filtering (QMF), etc. A particular embodiment implements a QMF as the TFT 502.

In general, the TFT 502 implements a signal processing operation that decomposes a signal (e.g., the training data 404) into different subbands using predefined prototype filters. The TFT 502 may implement a complex TFT (e.g., a complex QMF). The TFT 502 may use a block size of 64 samples. Thus, the TFT 502 generates the subbands 520 on a per-block basis of the training data 404. The TFT 502 may generate 77 subbands, which include 16 hybrid low subbands and 61 high subbands. The "hybrid" subbands have a different (smaller) bandwidth than the other subbands, and thus give better frequency resolution at the lower frequencies. The TFT 502 may be implemented as a signal processing function executed by a computing device.

The model generator 500 may implement a cutoff frequency of 7 kiloHertz. Everything below the cutoff frequency may be referred to as low frequency content, and everything above the cutoff frequency may be referred to as high frequency content. There is a direct mapping between the frequency index (e.g., from 1 to 77) and the corresponding center frequencies of the bandpass filters (e.g., from 0 to 22.05 kiloHertz) of the TFT 502. (The relationships between the frequency indices and center frequencies of the filters may be adjusted during the filter design phase.) So for the cutoff frequency of 7 kiloHertz, the frequency index of the 77 subbands is 34.

The cutoff frequency may be adjusted as desired. In general, the accuracy of the prediction models 310 is improved when the cutoff frequency corresponds to the maximum frequency of the input signal 140. If the input signal 140 has a cutoff frequency lower than the one used for training (e.g., the training data 404), the results may be less than optimal. To account for this adjustment, a new set of models trained on the new cutoff frequency setting may be generated. Thus, the cutoff frequency of 7 kiloHertz corresponds to an anticipated maximum frequency of 7 kiloHertz for the input signal 140.

HF Content Extractor 504

The HF content extractor 504 extracts the high frequency subbands 522 from the subbands 520. With the cutoff frequency index of 34, the high frequency subbands 522 are those above the cutoff frequency of 7 kiloHertz (e.g., subbands 35-77).

The HF content extractor 504 may perform grouping of the HF subbands 522 in the time and frequency domain. (Alternatively, the model trainer 512 may perform grouping of the HF subbands 522.) In general, grouping functions to down-sample the HF subbands 522 by different factors in time and frequency axes. Viewing the time-frequency representation of the HF subbands 522 as a matrix, grouping means taking the average within the same tile (of the matrix) and normalizing the tile by its energy. Grouping enables a tradeoff between the efficiency and the quality for the model generation process. The grouping factors may be adjusted, as desired, according to the desired tradeoffs.

A grouping factor of 4 may be used in both the time and frequency domains. For example, subbands 35-38 are in one frequency group, subbands 39-42 are in another frequency group, etc.; and blocks 1-4 are in one time group, blocks 5-8 are in another time group, etc. As another example, if the time-frequency matrix is 77 subbands and 200 blocks, then the grouped matrix will reduce to 50 blocks (200/4=50) and 45 sub-bands (fc+(77−fc)/4=44.75, rounds to 45), where fc is the cutoff frequency index (e.g., 34).

LF Content Extractor 506

The LF content extractor 506 extracts the low frequency subbands 524 from the subbands 520. With the cutoff frequency index of 34, the low frequency subbands 524 are those below the cutoff frequency of 7 kiloHertz (e.g., subbands 1-34). The subbands 1-16 are hybrid low bands, and the subbands 17-34 are low bands.

Feature Extractor 508

The feature extractor 508 extracts various features 526 from the low frequency subbands 524. The LF subbands 524 may be viewed as a complex matrix (e.g., similar to a FFT spectrogram), and the feature extractor 508 uses the magnitude part as the spectral envelope for extracting spectral-domain features. The LF subbands 524 may be resynthesized into a LF waveform from which the features extractor 508 extracts time-domain features. The feature extractor 508 extracts a number of time and frequency domain features, as shown in TABLE 1:

TABLE 1

| Domain | Name | Dimensionality |
|---|---|---|
| Spectral | Centroid | 1 |
| Spectral | Flatness | 1 |
| Spectral | Skewness | 1 |
| Spectral | Spread | 1 |
| Spectral | Flux | 1 |
| Spectral | Mel Frequency Cepstral Coefficient (MFCC) | 13 |
| Spectral | Tonal Power Ratio | 1 |
| Temporal | Root Mean Square (RMS) | 1 |
| Temporal | Zero Crossing Rate | 1 |
| Temporal | Autocorrelation Function (ACF) | 10 |

The block size of the temporal features depends on the grouping factor. The feature extractor 508 may segment the time domain signal (e.g., the LF subbands 524 resynthesized) into non-overlapping blocks with a block size equal to 64 times the grouping factor. The resulting feature vector (corresponding to the features 526) has 31 features per block. Since every feature has different scales, the feature extractor 508 performs a normalization processes to whiten the feature matrix of the features 526. The feature extractor 508 may perform the normalization processes using Equation 1:

$$X_{j,N} = \frac{X_j - \overline{X}_j}{S_j} \tag{1}$$

In Equation 1, $X_{j,N}$ is the normalized feature vector (corresponding to the features 526) $X_j$ is the jth feature vector, $\overline{X}_j$ is the mean, and $S_j$ is the standard deviation.

Clustering Block 510

The clustering block 510 performs clustering on the features 526 to generate the clustered features 528. In general, the clustering block 510 performs a clustering technique in the feature space. By grouping data with similar characteristics, it is more likely to obtain better envelope predictors.

The clustering block 510 may implement a k-means method as the clustering method. The k-means method may be summarized as follows. First, the clustering block 510 initializes k centroids by randomly selecting k samples from the data pool (e.g., the clustered features 528 for all the training data 404). Second, the clustering block 510 classifies every sample with a class label of 1 to k based on their distances to the k centroids. Third, the clustering block 510 computes the new k centroids. Fourth, the clustering block 510 updates the centroids. Fifth, the clustering block 510 repeats the second through fourth steps until convergence.

The clustering block 510 may set a maximum number of iterations (the fifth step above), for example 500 iterations. However, the process may converge sooner, e.g. between 200-300 iterations. The clustering block 510 may use the Euclidean distance as the distance measure. For a given set of training data 404, the optimal k is not necessarily the largest one. A large k for a small dataset could lead to overfitting issues, and it will not provide optimal groups for training the envelope predictors (see 562 in FIG. 5B). One way to search for an optimal k is to divide a small subset from the training data 404 as a validation set. The clustering block 510 may perform a grid search to find the best k based on the results from the validation set.

Suitable values for k range between 5 and 40. A larger k may be selected for a larger set of training data, e.g. to improve data clustering. If the selected k is too small for the training data, the number of samples becomes too large for each group, and the training process may become slow. For the first set of the training data 404 discussed above, k=5 is suitable. For the second set of the training data 404 discussed above, k=20 is suitable.

Model Trainer 512

The model trainer 512 performs model training by applying a support vector machine (SVM) to the clustered features 528 according to the high frequency subbands 522, to generate the prediction models 310. In general, the SVM is a linear classifier that defines an optimal hyperplane to separate the data in the feature space, by finding the support vectors that can maximize the margins. Compared with other classification algorithms, SVM has the flexibility of defining the margins, leading toward a more generic solution without over-fitting the data. The model trainer 512 may implement a MATLAB version of the SVM library LIBSVM.

For each block of the subbands 520, the model trainer 512 uses the high frequency subbands 522 as the labels, and the clustered features 528 as the features. The function of the model trainer 512 is to predict the high frequency spectral shape based on the low frequency contents. The model trainer 512 may implement a regression version of the SVM (nu-SVR) as the predictor, since the predicting values are continuous. To introduce non-linearity into the model, the model trainer 512 may use a Radial Basis Function (RBF) kernel for the SVM.

To further improve the results, the model trainer 512 may perform a grid search on a validation dataset to find the best parameters for the SVM. One parameter is ν (nu), which determines the margin. The higher it is, the more tolerable the model becomes, which implies a more generic model. Another parameter is γ (gamma), which determines the shape of the kernel function (e.g., for a Gaussian kernel). When the grouping index is 4 on the frequency axis, the number of high frequency subbands 522 reduces to ceil((77−fc)/4)=11. In general, the approach of the model trainer 512 is to train an individual predictor for each subband given the same set of features.

Blind Bandwidth Extension System 550

In FIG. 5B, the blind bandwidth extension system 550 includes a memory that stores the prediction models 310, a time-frequency transformer (TFT) 552, a low frequency (LF) content extractor 554, a feature extractor 556, a model selector 558, a high frequency (HF) content generator 560, a HF envelope predictor 562, and an inverse time-frequency transformer (ITFT) 564. The details of these components are provided in subsequent sections.

Time-Frequency Transformer 552

The TFT 552 generally generates a number of subbands 570 from the input signal 140 (e.g., converts the time domain information into frequency domain information). The settings and configuration of the TFT 552 may be similar to the settings and configuration for the TFT 502 (see FIG. 5A). (If the settings differ, a new set of models should be trained, or a different set of models should be used.) A particular embodiment implements a QMF as the TFT 552.

LF Content Extractor 554

The LF content extractor 554 extracts the low frequency subbands 572 from the subbands 570. The settings and configuration of the LF content extractor 554 may be similar to the settings and configuration for the LF content extractor 506 (see FIG. 5A).

Feature Extractor 556

The feature extractor 556 extracts various features 574 from the low frequency subbands 572. The feature extractor 556 may extract one or more of the same features extracted by the feature extractor 508 (see FIG. 5A), e.g., spectral features, temporal features, the specific features listed in TABLE 1, etc. In general, the feature extractor 556 should extract the same features as those extracted by the feature extractor 508 as part of generating the prediction models 310.

Model Selector 558

The model selector 558 selects one of the prediction models 310 (the selected model 576) according to the features 574. The model selector 558 may operate in a blockwise manner; e.g., for each block of the features 574, the model selector 588 selects one of the prediction models 310. The model selector 558 may select the best model based on the distance between the current block (of the features 574) and the k centroids (of a particular model). The distance measure may be the same measure as used by the clustering block 510, e.g. the Euclidean distance. The model selector 558 provides the selected model 576 to the HF envelope predictor 562.

The model selector 558 may select the selected model 576 as follows. First, the model selector 558 calculates the distance between the features 574 of the current block and the k centroids of each of the prediction models 310. Second, the model selector 558 selects the particular model with the smallest distance as the selected model 576. As a result, the selected model 576 is the model with the shortest distance to one of its centroids.

The model selector 558 may generate a blended model as the selected model 576. The model selector 558 may generate the blended model using a soft selection process. The model selector 558 may implement the soft selection process as follows. First, the model selector 558 calculates the distance between the features 574 of the current block and the k centroids for each of the prediction models 310. Second, instead of selecting a single model, the model selector 558 selects a number n of particular models with the smallest distances. For example, for n=4, the 4 particular models with the smallest distances are selected. Third, the model selector 558 aggregates the n particular models (e.g., aggregates the output from the closest models) to generate the selected model 576.

The model selector 558 may use envelope blending to generate a blended model as the selected model 576. First, the model selector 558 computes the similarities between the current block (of the features 574) and the k centroids for each of the prediction models 310. Second, the model selector 558 sorts the similarities in descending order. Third, the model selector 558 performs envelope blending using Equation 2:

$$S_{final} = \sum_{c=1}^{p} W_c \cdot S_c \tag{2}$$

In Equation 2, $S_{final}$ is the blended envelope between the top p predicted envelopes, $S_c$ is the predicted envelope for the c-th model (c≤k), and the weighting coefficients $W_c$ may be calculated using Equation 3:

$$W_c = \frac{ss_c}{\sum_{c=1}^{p} ss_c} \tag{3}$$

In Equation 3, $ss_c$ is the similarity between the current block and the c-th centroid, where $s_{cc}=1/d_c$, where $d_c$ is the distance measure. The distance measure may be Euclidean distance.

When p=1, this results in the selection of the single best model, as discussed above. A value such as p=3 may be used.

HF Content Generator 560

The HF content generator 560 generates interim subbands 578 by performing spectral band replication on the low frequency subbands 572. Spectral band replication creates copies of the low frequency subbands 572 and translates them toward the higher frequency regions. When the low frequency subbands 572 include 16 hybrid low bands (bands 1-16) and 18 low bands (bands 17-34), the HF content generator copies the 18 low bands and avoids the 16 hybrid low bands. (The hybrid low bands are avoided because the hybrid bands do not have the same bandwidth as the other bands, and the bands need to be compatible in order to replicate the content.) The HF content generator 560 provides the interim subbbands 578 to the HF envelope predictor 562.

The HF content generator 560 may implement a phase vocoder. The phase vocoder reduces the tone shift artifact cause by the mismatch of the harmonic structure between the original tones and the reconstructed tones.

HF Envelope Predictor 562

The HF envelope predictor 562 generates a predicted envelope based on the selected model 576, and generates HF subbands 580 from the interim subbands 578 using the predicted envelope. The HF envelope predictor 562 may perform envelope adjustment using a normalization process that normalizes the reconstructed QMF matrix (corresponding to the HF subbands 580) by its root-mean-square (RMS) values per grid, with the transmitted information (corresponding to the LF subbands 572) applied to adjust the spectral envelopes. As a result, the envelope adjustment adjusts the replicated parts so that they will have the predicted spectral shape.

When the model generator 500 (see FIG. 5A) performs grouping (e.g., using the HF content extractor 504 or the model trainer 512), the HF envelope predictor 562 may use similar grouping factors in order to "ungroup" the predicted coefficients. This results in the anticipated number of subbands for the HF subbands 580 being provided to the ITFT 564. For example, if the model generator 500 processes the HF envelope from 43 subbands into 11 groups, the HF envelope predictor 562 "ungroups" the 11 grouped predicted coefficients into the 43 subbands for the HF subbands 580.

Inverse Time-Frequency Transformer 564

The ITFT 564 performs inverse transformation on the LF subbands 572 and the HF subbands 580 to generate the output signal 150 (e.g., converts the frequency domain information into time domain information). In general, the ITFT 564 performs the inverse of the transformation performed by the TFT 552, and a particular embodiment implements an inverse QMF as the ITFT 564. The output signal 150 has an extended bandwidth, as compared to the input signal 140. For example, the input signal 140 may have a maximum frequency of 7 kiloHertz, and the output signal 150 may have a maximum frequency of 22.05 kiloHertz.

Noise Blending

The blind bandwidth extension system 550 may implement noise blending to suppress artifacts, by adding a noise blender between the HF envelope predictor 562 and the ITFT 564. (Alternatively, the noise blender may be added as a component of the HF envelope predictor 562 or of the ITFT 564.) The general concept is to add complex noise into the replicated parts (e.g., the HF subbands 580) in order to de-correlate the low frequency and high frequency contents. The implementation is shown in Equation 4:

$$X = \left(\alpha\frac{X_s}{\sigma_s} + \beta\frac{X_n}{\sigma_n}\right)\cdot\sigma_s \tag{4}$$

In Equation 4, X is the noise blended CQMF matrix, $X_s$ is the original CQMF matrix (e.g., corresponding to the HF subbands 580), $\sigma_s$ is the standard deviation of the signal, $X_n$ is the complex random noise matrix, and $\sigma_n$ is the standard deviation of the noise. $\alpha$ is the mixing coefficient of the signal, and $\beta=\sqrt{1-\alpha^2}$ is the mixing coefficient of the noise. $\alpha$ may be set heuristically to 0.9849.

Settings and Parameters

The model trainer 500 (see FIG. 5A) may be configured with the following parameters: k=20, grouping factor of 16 in the time axis, grouping factor of 4 in the frequency axis, and use only 10 seconds per song of the second set of training data 404. The blind bandwidth extension system 550 (see FIG. 5B) may be configured with the following parameters: grouping factor of 8 in the time axis, and grouping factor of 4 in the frequency axis.

Figure 6:
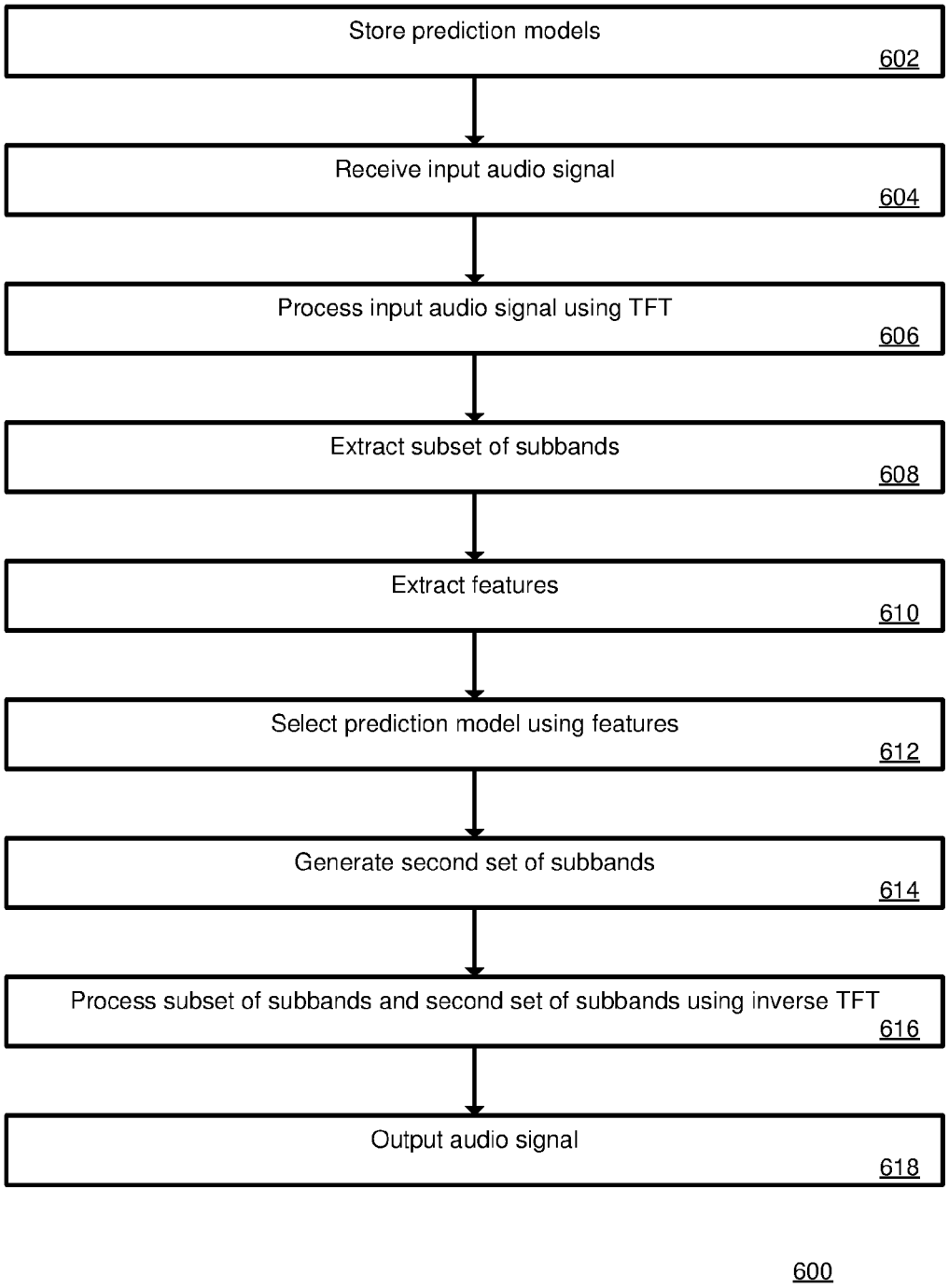
FIG. 6 is a flow diagram of a method 600 of blind bandwidth extension for musical audio signals.

FIG. 6 is a flow diagram of a method 600 of blind bandwidth extension for musical audio signals. The method 600 may be performed by the system 300 (see FIG. 3) or the blind bandwidth extension system 500 (see FIG. 5B), as implemented by the electronics 120 (see FIG. 1) in one of the devices 210, 220 or 230 (see FIGS. 2A-2C). The method 600 may be implemented by one or more computer programs that are stored in a memory (e.g., 124 in FIG. 1) and executed by a processor (e.g., 122 in FIG. 1).

At 602, a number of prediction models are stored. (Note that "are stored" refers to the state of being in storage, not necessarily to an active step of storing previously-unstored models.) The prediction models were generated using an unsupervised clustering method (e.g., a k-means method) and a supervised regression process (e.g., a support vector machine). A memory may store the prediction models (e.g., the memory 124 of FIG. 1 may store the prediction models 310 of FIG. 3).

At 604, an input audio signal is received. The input audio signal may be received by a processor (e.g., the processor 122 in FIG. 1 receives the input signal 140). The input audio signal has a frequency range between zero and a first frequency (e.g., 7 kiloHertz).

At 606, the input audio signal is processed to generate a number of subbands. In general, the processing transforms a time domain signal into a frequency domain signal. For example, the processor 122 (see FIG. 1) may implement the TFT 302 (see FIG. 3) to generate the subbands 330, or the TFT 552 (see FIG. 5B) to generate the subbands 570. A particular embodiment may process the input audio signal using a QMF.

At 608, a subset of subbands are extracted from the plurality of subbands, where a maximum frequency of the subset is less than a cutoff frequency (e.g., 7 kiloHertz). For example, the processor 122 (see FIG. 1) may implement the LF content extractor 304 (see FIG. 3) to extract the LF subbands 332, or the LF content extractor 554 (see FIG. 5B) to extract the LF subbands 572.

At 610, a number of features are extracted from the subset of subbands. For example, the processor 122 (see FIG. 1) may implement the feature extractor 306 (see FIG. 3) to extract the features 334, or the feature extractor 556 (see FIG. 5B) to extract the features 574.

At 612, a selected prediction model is selected from the plurality of prediction models using the plurality of features. For example, the processor 122 (see FIG. 1) may implement the model selector 308 (see FIG. 3) to select the selected model 336, or the model selector 558 (see FIG. 5B) to select the selected model 576.

At 614, a second set of subbands are generated by applying the selected prediction model to the subset of subbands, where a maximum frequency of the second set of subbands is greater than the cutoff frequency (e.g., the maximum frequency may be 22.05 kiloHertz). For example, the processor 122 (see FIG. 1) may implement the HF content generator 312 (see FIG. 3) to generate the HF subbands 338. As another example, the processor 122 may implement the HF content generator 560 and the HF envelope predictor 562 (see FIG. 5B) to generate the HF subbands 580.

At 616, the subset of subbands and the second set of subbands are processed to generate an output audio signal, where the output audio signal has a maximum frequency greater than the first frequency (e.g., the output audio signal has a maximum frequency of 22.05 kiloHertz). In general, 616 performs the inverse of 606, to transform the subbands (frequency domain information) back into time domain information. For example, the processor 122 (see FIG. 1) may implement the ITFT 314 to generate the output signal 322 from the LF subbands 332 and the HF subbands 338, or the ITFT 564 (see FIG. 5B) to generate the output audio signal 150 from the LF subbands 572 and the HF subbands 580. A particular embodiment may perform the transformation using an inverse QMF At 618, the output audio signal is outputted. For example, the speaker 110 (see FIG. 1) may output the output audio signal 150.

Figure 7:
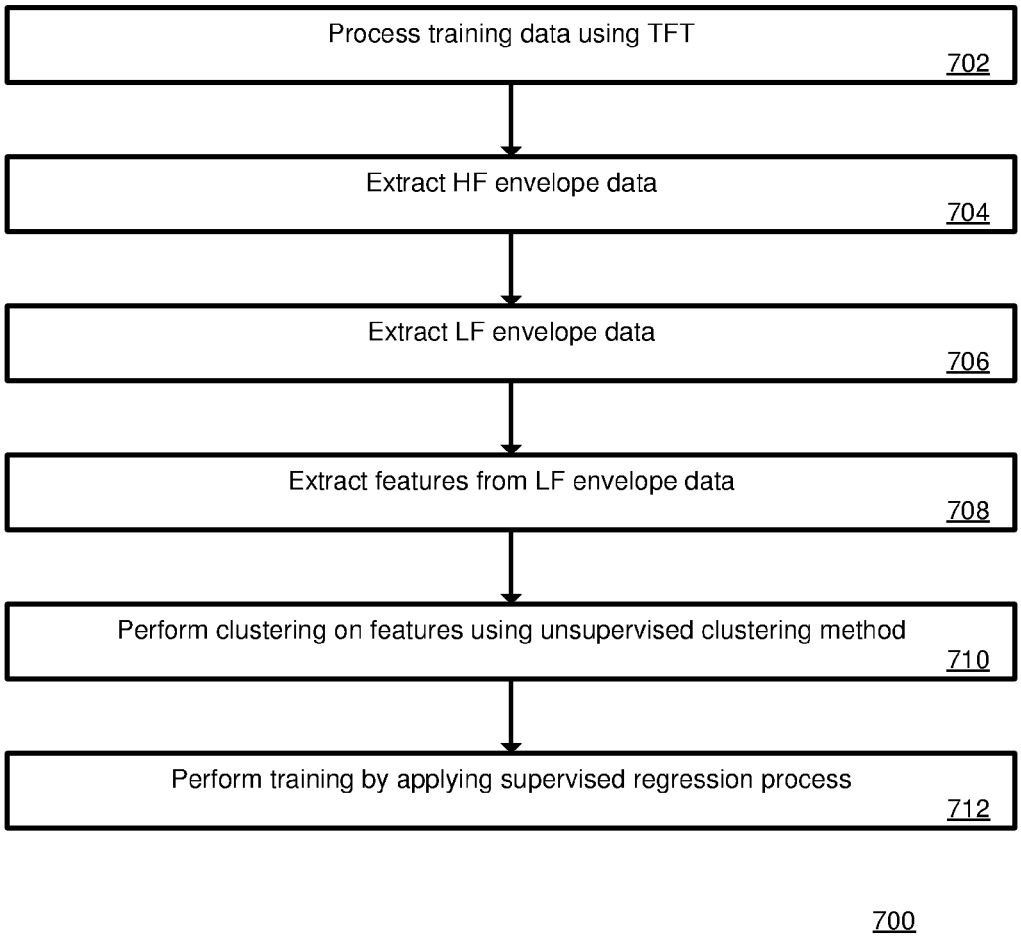
FIG. 7 is a flow diagram of a method 700 of generating prediction models.

FIG. 7 is a flow diagram of a method 700 of generating prediction models. The method 700 may be performed by the model generator 402 (see FIG. 4A), as implemented by the electronics 410 (see FIG. 4B) in the computer 430 (see FIG. 4C). The method 700 may be implemented by one or more computer programs that are stored in a memory (e.g., 414 in FIG. 4B) and executed by a processor (e.g., 412 in FIG. 4B).

At 702, a plurality of training audio data is processed using a quadrature mirror filter to generate a number of subbands. For example, the processor 412 (see FIG. 4B) may implement the TFT 502 (see FIG. 5A) to process the training data 404 and to generate the subbands 520.

At 704, high frequency envelope data is extracted from the subbands. For example, the processor 412 (see FIG. 4B) may implement the HF content extractor 504 (see FIG. 5A) to extract the HF subbands 522 from the subbands 520.

At 706, low frequency envelope data is extracted from the subbands. For example, the processor 412 (see FIG. 4B) may implement the LF content extractor 506 (see FIG. 5A) to extract the LF subbands 524 from the subbands 520.

At 708, a number of features are extracted from the low frequency envelope data. For example, the processor 412 (see FIG. 4B) may implement the feature extractor 508 (see FIG. 5A) to extract the features 526 from the low frequency subbands 524.

At 710, clustering is performed on the features using an unsupervised clustering method to generate a clustered number of features. For example, the processor 412 (see FIG. 4B) may implement the clustering block 510 (see FIG. 5A) that performs an unsupervised clustering method to generate the clustered features 528. A particular embodiment uses a k-means method as the unsupervised clustering method.

At 712, training is performed by applying a supervised regression process to the clustered features and the high frequency envelope data, to generate the prediction models. For example, the processor 412 (see FIG. 4B) may implement the model trainer 512 (see FIG. 5A) that uses a supervised regression process to generate the prediction models 310 based on the clustered features 528 and the HF subbands 522. A particular embodiment uses a support vector machine as the supervised regression process.

IMPLEMENTATION DETAILS

An embodiment may be implemented in hardware, executable modules stored on a computer readable medium, or a combination of both (e.g., programmable logic arrays). Unless otherwise specified, the steps executed by embodiments need not inherently be related to any particular computer or other apparatus, although they may be in certain embodiments. In particular, various general-purpose machines may be used with programs written in accordance with the teachings herein, or it may be more convenient to construct more specialized apparatus (e.g., integrated circuits) to perform the required method steps. Thus, embodiments may be implemented in one or more computer programs executing on one or more programmable computer systems each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a non-transitory computer-readable storage medium, configured with a computer program, where the storage medium so configured causes a computer system to operate in a specific and predefined manner to perform the functions described herein. (Software per se and intangible or transitory signals are excluded to the extent that they are unpatentable subject matter.)

The above description illustrates various embodiments of the present invention along with examples of how aspects of the present invention may be implemented. The above examples and embodiments should not be deemed to be the only embodiments, and are presented to illustrate the flexibility and advantages of the present invention as defined by the following claims. Based on the above disclosure and the following claims, other arrangements, embodiments, implementations and equivalents will be evident to those skilled in the art and may be employed without departing from the spirit and scope of the invention as defined by the claims.

What is claimed is:

1. A method of performing blind bandwidth extension of a musical audio signal, the method comprising:

storing, by a memory, a plurality of prediction models, wherein the plurality of prediction models were generated using an unsupervised clustering method and a supervised regression process;

receiving, by a processor, an input audio signal, wherein the input audio signal has a frequency range between zero and a first frequency;

processing, by the processor, the input audio signal using a time-frequency transformer to generate a plurality of subbands;

extracting, by the processor, a subset of subbands from the plurality of subbands, wherein a maximum frequency of the subset is less than a cutoff frequency;

extracting, by the processor, a plurality of features from the subset of subbands;

selecting, by the processor, a selected prediction model from the plurality of prediction models using the plurality of features;

generating, by the processor, a second set of subbands by applying the selected prediction model to the subset of subbands, wherein a maximum frequency of the second set of subbands is greater than the cutoff frequency;

processing, by the processor, the subset of subbands and the second set of subbands using an inverse time-frequency transformer to generate an output audio signal, wherein the output audio signal has a maximum frequency greater than the first frequency; and outputting, by a speaker, the output audio signal.

2. The method of claim 1, wherein the unsupervised clustering method comprises a k-means method.

3. The method of claim 1, wherein the supervised regression process comprises a support vector machine.

4. The method of claim 1, wherein the time-frequency transformer comprises a quadrature mirror filter, and wherein the inverse time-frequency transformer comprises an inverse quadrature mirror filter.

5. The method of claim 1, wherein the first frequency is 7 kiloHertz, wherein the cutoff frequency is 7 kiloHertz, and wherein the maximum frequency of the output audio signal is 22.05 kiloHertz.

6. The method of claim 1, wherein the time-frequency transformer generates 77 subbands, and wherein a block size of the time-frequency transformer is 64 samples of the input audio signal.

7. The method of claim 1, wherein the time-frequency transformer generates 77 subbands, wherein the 77 subbands include 16 hybrid low bands and 61 high bands.

8. The method of claim 1, wherein the time-frequency transformer generates 77 subbands, wherein the cutoff frequency is 7 kiloHertz, and wherein a frequency index of the cutoff frequency in the 77 subbands is 34.

9. The method of claim 1, wherein the second set of subbands are generated using spectral band replication on the subset of subbands.

10. The method of claim 1, wherein generating the second set of subbands comprises:

generating a predicted envelope based on the selected prediction model;

generating an interim set of subbands by performing spectral band replication on the subset of subbands; and generating the second set of subbands by adjusting the interim set of subbands according to the predicted envelope.

11. The method of claim 1, wherein the plurality of prediction models have a plurality of centroids, wherein selecting the selected prediction model comprises:

calculating, for the plurality of features for a current block, a plurality of distances between the current block and the plurality of centroids; and selecting the selected prediction model based on a smallest distance of the plurality of distances.

12. The method of claim 1, wherein the plurality of prediction models have a plurality of centroids, wherein selecting the selected prediction model comprises:

calculating, for the plurality of features for a current block, a plurality of distances between the current block and the plurality of centroids;

selecting a subset of the plurality of prediction models having a smallest subset of distances; and aggregating the subset of the plurality of prediction models to generate a blended prediction model, wherein the blended prediction model is selected as the selected prediction model.

13. The method of claim 1, wherein the plurality of features includes a plurality of spectral features and a plurality of temporal features.

14. The method of claim 1, wherein the plurality of features includes a plurality of spectral features, wherein the plurality of spectral features includes a centroid feature, a flatness feature, a skewness feature, a spread feature, a flux feature, a mel frequency cepstral coefficients feature, and a tonal power ratio feature.

15. The method of claim 1, wherein the plurality of features includes a plurality of temporal features, wherein the plurality of temporal features includes a root mean square feature, a zero crossing rate feature, and an autocorrelation function feature.

16. The method of claim 1, further comprising:

generating the plurality of prediction models from a plurality of training audio data using the unsupervised clustering method and the supervised regression process.

17. The method of claim 16, wherein generating the plurality of prediction models comprises:

processing the plurality of training audio data using a second time-frequency transformer to generate a second plurality of subbands;

extracting high frequency envelope data from the second plurality of subbands;

extracting low frequency envelope data from the second plurality of subbands;

extracting a second plurality of features from the low frequency envelope data;

performing clustering on the second plurality of features using the unsupervised clustering method to generate a clustered second plurality of features; and performing training by applying the supervised regression process to the clustered second plurality of features and the high frequency envelope data, to generate the plurality of prediction models.

18. The method of claim 17, wherein performing training comprises:

performing training by using a radial basis function kernel for the supervised regression process.

19. An apparatus for performing blind bandwidth extension of a musical audio signal, the apparatus comprising:

a processor;

a memory that stores a plurality of prediction models, wherein the plurality of prediction models were generated using an unsupervised clustering method and a supervised regression process; and a speaker, wherein the processor is configured to control the apparatus to execute processing comprising:

receiving, by the processor, an input audio signal, wherein the input audio signal has a frequency range between zero and a first frequency;

processing, by the processor, the input audio signal using a time-frequency transformer to generate a plurality of subbands;

extracting, by the processor, a subset of subbands from the plurality of subbands, wherein a maximum frequency of the subset is less than a cutoff frequency;

extracting, by the processor, a plurality of features from the subset of subbands;

selecting, by the processor, a selected prediction model from the plurality of prediction models using the plurality of features;

generating, by the processor, a second set of subbands by applying the selected prediction model to the subset of subbands, wherein a maximum frequency of the second set of subbands is greater than the cutoff frequency;

processing, by the processor, the subset of subbands and the second set of subbands using an inverse time-frequency transformer to generate an output audio signal, wherein the output audio signal has a maximum frequency greater than the first frequency; and outputting, by the speaker, the output audio signal.

20. A non-transitory computer readable medium storing a computer program for controlling a device to perform blind bandwidth extension of a musical audio signal, wherein the device includes a processor, a memory that stores a plurality of prediction models, and a speaker, wherein the plurality of prediction models were generated using an unsupervised clustering method and a supervised regression process, wherein the computer program when executed by the processor controls the device to perform processing comprising:

receiving, by the processor, an input audio signal, wherein the input audio signal has a frequency range between zero and a first frequency;

processing, by the processor, the input audio signal using a time-frequency transformer to generate a plurality of subbands;

extracting, by the processor, a subset of subbands from the plurality of subbands, wherein a maximum frequency of the subset is less than a cutoff frequency;

extracting, by the processor, a plurality of features from the subset of subbands;

selecting, by the processor, a selected prediction model from the plurality of prediction models using the plurality of features;

generating, by the processor, a second set of subbands by applying the selected prediction model to the subset of subbands, wherein a maximum frequency of the second set of subbands is greater than the cutoff frequency;

processing, by the processor, the subset of subbands and the second set of subbands using an inverse time-frequency transformer to generate an output audio signal, wherein the output audio signal has a maximum frequency greater than the first frequency; and outputting, by the speaker, the output audio signal.

* * * * *